US009458843B2

(12) United States Patent
Cardelius et al.

(10) Patent No.: US 9,458,843 B2
(45) Date of Patent: Oct. 4, 2016

(54) PUMP ARRANGEMENT WITH TWO PUMP UNITS, SYSTEM, USE AND METHOD

(75) Inventors: Erik Cardelius, Djursholm (SE); Svante Bahrton, Hägersten (SE); Markus Eklund, Stocksund (SE); Kasper Höglund, Rönninge (SE)

(73) Assignee: ALFA LAVAL CORPORATE AB, Lund (SE)

( * ) Notice: Subject to any disclaimer, the term of this patent is extended or adjusted under 35 U.S.C. 154(b) by 1438 days.

(21) Appl. No.: 13/141,796

(22) PCT Filed: Dec. 18, 2009

(86) PCT No.: PCT/EP2009/067522

§ 371 (c)(1),
(2), (4) Date: Sep. 8, 2011

(87) PCT Pub. No.: WO2010/076243

PCT Pub. Date: Jul. 8, 2010

(65) Prior Publication Data

US 2011/0318195 A1 Dec. 29, 2011

(30) Foreign Application Priority Data

Dec. 29, 2008 (SE) ..... 0850185

(51) Int. Cl.
*F04B 9/12* (2006.01)
*F04B 9/117* (2006.01)
(Continued)

(52) U.S. Cl.
CPC ..... *F04B 23/04* (2013.01); *F04B 9/1172* (2013.01); *F04B 13/00* (2013.01); *F04B 49/065* (2013.01); *F04B 9/1222* (2013.01)

(58) Field of Classification Search
CPC ..... F04B 9/117; F04B 9/1172; F04B 9/1176; F04B 9/1178; F04B 9/1174; F04B 23/04; F04B 13/00; F04B 49/065; F15B 9/08
USPC ..... 417/46, 53, 390, 395; 91/281
See application file for complete search history.

(56) References Cited

U.S. PATENT DOCUMENTS 3,516,761 A 6/1970 Scroggins
3,540,349 A * 11/1970 Pennther ..... 91/306
(Continued)

FOREIGN PATENT DOCUMENTS

EP 0080385 A1 11/1982
EP 0169655 A1 6/1985
(Continued)

OTHER PUBLICATIONS

International Search Report; International Application No. PCT/EP2009/067522; Date Mailed May 5, 2010.
(Continued)

*Primary Examiner* — Devon Kramer
*Assistant Examiner* — Nathan Zollinger
(74) *Attorney, Agent, or Firm* — MKG, LLC

(57) ABSTRACT

A pump arrangement comprising two pump units, each pump unit comprising a pumping cylinder, a reciprocally movable pumping piston, said pumping piston delimiting a pumping chamber in the pumping cylinder in communication with a pump port for fluids, an actuator connected to the pumping piston, and determining a value dependent on the position of the pumping piston in the pumping cylinder, said pump arrangement further comprises a inlet and delivery valves connecting the pump port of each pump unit to a source line and a delivery line for pumped fluids, wherein the pump arrangement comprises at least one regulating unit the flow of the pumped fluids based on the value dependent on the positions of the pumping pistons in the pump units. Also a system comprising such a pump arrangement and a method for pumping fluids in said pump arrangement.

16 Claims, 4 Drawing Sheets

(51) Int. Cl.

| | |
|---|---|
| ***F04B 23/04*** | (2006.01) |
| ***F04B 13/00*** | (2006.01) |
| ***F04B 49/06*** | (2006.01) |

(56) References Cited

U.S. PATENT DOCUMENTS

| | | | | |
|---|---|---|---|---|
| 3,893,790 | A | 7/1975 | Mayer | |
| 4,021,156 | A | 5/1977 | Fuchs, Jr. et al. | |
| 4,195,752 | A * | 4/1980 | Heimgartner et al. | 222/61 |
| 4,666,374 | A | 5/1987 | Nelson | |
| 4,823,552 | A * | 4/1989 | Ezell et al. | 60/443 |
| 5,259,731 | A | 11/1993 | Dhindsa et al. | |
| 5,634,773 | A * | 6/1997 | Tanino et al. | 417/46 |
| 5,634,779 | A | 6/1997 | Eysymontt | |
| 6,079,959 | A * | 6/2000 | Kingsford | F04B 43/0054 417/393 |
| 6,113,368 | A | 9/2000 | Hofmann | |
| 6,135,719 | A | 10/2000 | Yoder et al. | |
| 6,135,724 | A | 10/2000 | Yoder et al. | |
| 6,159,442 | A * | 12/2000 | Thumm | B01J 3/00 239/420 |
| 6,328,542 | B1 | 12/2001 | Serafin et al. | |
| 6,827,479 | B1 | 12/2004 | Xia et al. | |
| 6,957,567 | B2 | 10/2005 | Kolbe et al. | |
| 2003/0118459 | A1 | 6/2003 | Gerhardt et al. | |
| 2004/0187562 | A1 | 9/2004 | Kolbe et al. | |
| 2007/0177998 | A1 * | 8/2007 | Kato | F04B 7/02 417/395 |
| 2009/0257888 | A1 * | 10/2009 | Harrington | F02K 9/46 417/53 |
| 2011/0008188 | A1 * | 1/2011 | Di Leo | F04B 9/129 417/375 |
| 2011/0008189 | A1 * | 1/2011 | Nguyen | F04B 9/127 417/399 |

FOREIGN PATENT DOCUMENTS

| | | | |
|---|---|---|---|
| EP | 1437509 | | 7/2004 |
| EP | 1332288 | B1 | 1/2007 |
| FR | 2689571 | | 4/1992 |
| GB | 2175352 | A | 11/1986 |
| GB | 2344141 | A | 5/2000 |
| JP | 59105977 | A1 | 12/1982 |
| JP | 2002-005030 | | 9/2002 |
| JP | 2008-223550 | | 9/2008 |
| WO | 9400689 | A1 | 1/1994 |
| WO | WO 9608648 | A1 * | 3/1996 |
| WO | 02638958 | A1 | 5/2002 |
| WO | WO 0238958 | A1 * | 5/2002 |
| WO | 2007050013 | A1 | 5/2007 |

OTHER PUBLICATIONS

English translation of First Office Action for Japanese Patent Application No. 2011-542786, dated Apr. 23, 2013.

* cited by examiner

PUMP ARRANGEMENT WITH TWO PUMP UNITS, SYSTEM, USE AND METHOD

FIELD OF THE INVENTION

The present invention relates to a pump arrangement for pumping fluids, a system comprising such a pump arrangement, the use of such a pump arrangement and a method for controlling such a pump arrangement.

BACKGROUND

Pump arrangements of today can be positive displacement pumps such as gear pumps, centrifugal pumps and plunger or piston pumps. Known pump arrangements have problems which are related to the control of the flow of pumped fluids, to the supply of fluids at a constant pressure with or without any fluid flow, to variations in pressure during pumping of the fluids, to cavitation in the pump units, to slow starting procedures and to operational noise. One known pump arrangement is described in U.S. Pat. No. 6,135,724 A.

The present invention resides in one aspect in a pump arrangement which comprises a first and a second pump unit for pumping of fluids with a controlled pressure of said fluids. The pump arrangement of the invention also provides a continuous flow or a pulsed flow of said fluids. Suitably the pump arrangement can be used to supply a constant pressure with or without any fluid flow and the pump arrangement can provide a rapid starting procedure. A further benefit of the invention is to obtain a pump arrangement with a safe and controllable pressure limitation.

In one embodiment, a pump arrangement for pumping fluids includes at least a first and a second pump unit. Fluids may be defined as gases, liquids, particles or mixtures thereof, which can be made to flow under an applied shear stress. Each pump unit comprises a pumping cylinder and a reciprocally movable pumping piston in said pumping cylinder. The cross-section of the pumping piston can be substantially circular, elliptical, rectangular or have any other suitable shape. The pumping piston is leak-tight fitted in said pumping cylinder by means of a seal or by any other known means. The pumping piston delimits a pumping chamber in the pumping cylinder, in communication with one or more pump ports for the fluids to be pumped. The pump unit further comprises an actuator connected to the pumping piston, for moving said pumping piston. The actuator can be a linear actuator that is capable of producing a constant and well defined force independent of the position of piston and throughout the relevant length of the stroke.

The mentioned pump units may further comprise means for determining a value dependent on the continuous position of the pumping piston in the pumping cylinder. The value can be a continuous value, or a discrete representation of a continuous value with a resolution to resolve the movement or the position of the pumping piston sufficiently high as demanded by the application. The continuous position can be determined throughout the relevant stroke of the pumping piston. The determined value may be composed of or transformed to any of the following alternatives, or combinations of alternatives according to the present invention. Said determining means can comprise a transducer for determining the value dependent on the position of the pumping piston in the pumping cylinder. As an alternative to position, the value dependent on the position can be the velocity of the pumping piston, the acceleration of the pumping piston or any other parameter dependent on the position of the pumping piston. The position of the pumping piston in the pumping cylinder may also be determined by a transducer arranged to determine a value dependent on the position of the driving piston in the driving cylinder or on the position of the rod in relation to the driving- or pumping cylinders. The transducer can be a linear encoder that encodes position and converts the position into analog or digital position signals. Motion, velocity or acceleration can be determined by change in position over time. The transducer can utilize any known resistive, capacitive, inductive, eddy current, magnetic, or optical means for position measurements or combinations thereof. The position transducer may also be a rotary encoder or transducer coupled to a rotating part that rotates in relation to the motion of the pumping piston and converts the angular displacement into analog or digital position signals.

The pump arrangement may comprise a first set of valves connecting the one or more pump ports of each pump unit to at least one source line and a delivery line for transporting the fluids to be pumped. The pump arrangement may further comprise means for regulating the volume of the flow from at least one of said pump units of the fluids to be pumped based on the value dependent on the continuous position of the pumping piston in at least one of the pump units. Thus the flow of fluids to be pumped through the delivery line may be regulated based on the position or movement of the pumping piston in the pumping cylinder of at least one of the pump units. The flow of fluids to be pumped may therefore be regulated quickly and correctly upon a change in operational conditions of the pump arrangement.

The determined value which is dependent on the position may be a measurement of, a calculation of or a conversion to the velocity of a pumping piston in a pump unit, whereby the means for regulating the flow of the fluids may be used to control the volume of the flow from said pump unit. The determined value dependent on the position may also be a measurement of, a calculation of or a conversion to the acceleration of a pumping piston in a pump unit, whereby the means for regulating the flow of the fluids may be used to control the ramping of the flow, increasing or decreasing the flow velocity from said pump unit.

Determined values dependent on the position of the pumping pistons in several pump units can be combined in order to regulate the flow of the fluids to be pumped on their combined behaviour. By regulating the flow based on the sum of the values dependent on the position, the combined flow can be controlled. The flow may also be based on the difference of the values dependent on the position, or in any other suitable way.

The determined value dependent on the position can also be the actual position of the pumping piston in a pump unit. This can be utilized in order to detect problems within the pump arrangement, such as leakage or cavitation, and the means for regulating the flow of the fluids to be pumped can be arranged to halt the system or adjust the driving parameters of the actuator control in order to avoid the problems or to reach a correct volumetric flow. Changes in the behaviour of the pump arrangement, as determined by the values dependent on the positions of pumping pistons in one or several pump units, can be used to indicate problems within the pump arrangement. Problems within the pump arrangement may be detected by variations in velocity between pumping pistons in different pump units, by variations in the cycle time of different pump units or by variations in the velocity of a pumping piston in a pump unit during filling or emptying the pumping chamber.

The pump arrangement can also comprise means for measuring the pressure in the arrangement. The pump arrangement may comprise means for measuring the pressure in the delivery line, up- or downstream of the means for regulating the flow of the fluids to be pumped. The pump arrangement may have means for measuring the pressure in the pumping chambers of the pump units. The computer based control unit system can be arranged to receive an input parameter representing said pressure, and to process said input parameter to one or more output parameters for controlling the means for regulating the flow of the fluids to be pumped. The output parameter may be used to control the driving of the actuators in order to adjust the forces supplied to the pumping pistons. This can be used to counteract any imbalance or variation between the pump units. The measured pressure parameter can also be used together with the values dependent on the position to detect problems within the pump arrangement, such as leakage or cavitation.

The actuator may be a fluid power actuator comprising a driving cylinder, a reciprocally movable driving piston in said driving cylinder, which is connected to the pumping piston for moving the pumping piston. The driving piston divides the driving cylinder into a first and a second driving chamber in communication with a first and a second drive port for drive medium. The pump arrangement may comprise a second set of valves for controlling the delivery of drive medium to the driving chambers of the pump units. Suitable drive media may be fluids according to the definition above, or partial vacuum. The fluid power actuator may be a pneumatic actuator, wherein the drive medium comprises a gas such as air, or a hydraulic actuator, wherein the drive medium comprises a hydraulic fluid known in the art such as oil, water, synthetic compounds or mixtures thereof. One advantage of having pneumatic actuators is that the maximum pressure can be regulated in order to minimize the risk of delivering too high pressure on the delivery side of the pump arrangement. The second set of valves can be on/off valves, but can also be arranged to continuously regulate the flow and/or pressure of the drive medium into or out from the corresponding drive chambers. The second set of valves can be used to ventilate the corresponding drive chamber by opening the driving chambers to a venting circuit for the drive medium. If the drive medium comprises a gas, such as air, the drive medium can be vented into the ambient surrounding. The driving cylinders may comprise first and second dedicated ventilation valves for drive medium from said first and second drive chambers.

The actuator may be an electromagnetic actuator comprising at least one stationary part and one reciprocally movable part, said parts comprising at least one coil and one magnet. The electromagnetic actuator may be of a voice coil type, wherein a reciprocally movable electrical coil is surrounding or surrounded by a stationary permanent magnet or electromagnet. The electromagnetic actuator may comprise a reciprocally movable magnet surrounding or surrounded by a stationary electrical coil.

The means for regulating the flow of the fluids to be pumped may comprise at least one valve on the delivery line. This valve can be a proportional valve for regulation of a continuous fluid flow or an on/off valve for pulse width modulation of a fluid flow. A proportional valve can be any suitable valve with a variable cross-sectional flow area, or with a variable flow resistance. The means for regulating the flow of the fluids to be pumped may comprise means for regulating the force applied to the pumping pistons by the corresponding actuators.

The first set of valves may comprise two check valves connecting each of the first and the second pump units to the source line and two check valves connecting each of the first and the second pump units to the delivery line. The check valves are arranged to permit a flow of fluids from the source line via the pumping chambers to the delivery line. The first set of valves may comprise on/off valves that are controlled to open and close during a pumping cycle of the arrangement in order to permit a flow of fluids from the source line via the pumping chambers to the delivery line. The first set of valves may further comprise a valve connecting the pumping chamber to the source or delivery line via a pump port on or close to the movable pumping piston, such as integrated with the sealing of the pumping piston in the pumping cylinder.

The second set of valves may comprise valves for controlling the delivery of drive medium with a pressure $P_1$ to the first driving chambers of the pump units and/or drive medium with a pressure $P_2$ to the second driving chambers of the pump units. Drive medium with pressure $P_1$ and $P_2$ may be supplied to the pump units from a common pressure supply via at least one regulating unit. The first and second driving chambers of the pump units may be connected to individual pressure sources supplying drive media with pressures $P_1$, $P_2$, $P_3$ and $P_4$. The driving chambers may alternatively be connected to one or more pressure sources via one or more regulating units, controlling the pressure or flow of drive medium to the different pump units and/or to the different driving chambers of the pump units. The regulating units can be pressure regulators, proportional valves, various control valves or combinations thereof.

The pumping piston has a cross-sectional area $A_P$ and the driving piston has a cross-sectional area $A_D$. The cross-sectional area $A_P$ of the pumping piston can suitably be smaller than the cross-sectional area $A_D$ of the driving piston thereby bringing about an increase of the pressure in the pumping chamber in relation to the pressure in the first driving chamber.

The fluid power actuator can comprise one or more additional driving cylinders, each additional driving cylinder comprising a reciprocally movable driving piston dividing said additional driving cylinder into a first and a second driving chamber in communication with a first and a second drive port for drive medium. The driving piston in said additional driving cylinder is connectable by connection means to the driving piston in the main driving cylinder. The cross-sectional area of the driving piston in said additional driving cylinder is suitably larger than the cross-sectional area $A_D$ of the driving piston in the main driving cylinder. The one or more additional driving cylinders can be used to apply force to the pumping pistons in the pumping cylinders when there is a need for higher pumping pressures. The main driving cylinder can in this case be used to apply force to the pumping pistons in the pumping cylinders when there is a need for high precision in pumping pressure. The driving piston in the additional driving cylinder may be connectable to yet another driving cylinder and so on. The cross-sectional area of the driving piston in said yet another driving cylinder is suitably larger than the cross-sectional area of the driving piston in said additional driving cylinder. By making use of one or more of the driving cylinders, a wide range of forces can be applied to the fluid in the pumping chamber of the corresponding pump unit. The second set of valves further comprises valves for controlling the delivery of drive medium to the driving chambers of the additional driving cylinders.

The connection means for connecting the driving piston in an additional driving cylinder to the driving piston in the main driving cylinder may be arranged to transfer a pushing force from the additional driving cylinder to the driving piston in the main driving cylinder, while not transmitting a pulling force. This can be arranged by providing mechanical contact between the driving pistons in the driving cylinders. Thereby the main driving cylinder can be used to pump fluid from the pumping chamber with a high precision, without having to move the pumping piston in the additional driving cylinder. Similar connection means can be used between additional driving cylinders in a series of driving cylinders.

The means for regulating the flow of the fluids to be pumped may comprise a computer based control unit system connected to the valves in the pump arrangement. The computer based control unit system can be arranged to receive an input parameter representing said value dependent on the position of the pumping piston in the pumping cylinder, and process said input parameter to one or more output parameters for controlling the means for regulating the flow of the fluids to be pumped by the pump arrangement. The computer based control unit system may also control the first and second set of valves to open and close within predetermined time intervals or at predetermined positions of the pumping pistons in the pumping cylinders, as determined by the means for determining a value dependent on the position of the pumping piston in the pumping cylinder.

The pump arrangement can be provided with a nozzle on the delivery line, said nozzle comprising a disperser element for dispersing the fluid to be pumped. The nozzle can comprise one or more holes at the outlet end in order to disperse the fluid exiting the nozzle. An example of a nozzle that can be connected to the pump arrangement for the injection of a fluid in a continuous chemical reactor or a flow module is further disclosed in WO 2007050013 A1, other types of suitable nozzles are also possible according to the invention.

The pump arrangement may comprise at least two pump units, wherein each pump unit comprises a pumping cylinder having a pump port, a reciprocally movable pumping piston, a driving cylinder having two drive ports for drive medium, and a reciprocally movable driving piston, wherein a rod is interconnecting the pumping piston with the driving piston, and the pump arrangement comprises further two or more check valves connecting the pump ports of the at least two pump units to at least one source line and at least one delivery line of the fluids to be pumped, the pump arrangement comprises further two or more valves connecting the driving cylinders to at least one drive medium source, and the pump arrangement comprises further flow regulating means for regulating the volume of the flow from at least one of said pump units of the fluids to be pumped dependent on the continuous position of the pumping piston in the pumping cylinder.

The present invention relates also to a system comprising a pump arrangement and a continuous chemical reactor or a flow module, wherein the delivery line of said pump arrangement is connected to a port of the continuous chemical reactor or flow module. The delivery line of the pump arrangement may be provided with a nozzle that is suitable for injecting a fluid into the flow of another fluid. The nozzle may comprise a disperser element suitable for spraying or dispersing the fluid to be pumped into a fluid channel in the continuous chemical reactor or flow module. The nozzle can thus be used to produce fine dispersions of miscible or non-miscible liquids that are introduced into a process flow in the chemical reactor or flow module. The disperser may comprise one or more fine holes in order to produce fine dispersions of the fluids. The pump arrangement could continuously pump fluids to the nozzle or feed the nozzle in a pulsed mode. The pump is suitably controlled to maintain a given pressure level.

The present invention also relates to the use of a pump arrangement or a system comprising a pump arrangement to introduce fluids into a continuous chemical reactor or a flow module. The pump arrangement according to the invention may be used with a chemical reactor or a flow module. Examples of suitable continuous chemical reactors or flow modules are disclosed by WO 2007050013 A1 or SE 0950247-7. The combination of the pump arrangement and the continuous chemical reactor or continuous flow module can be used for reactions, extractions, separations, mixing, etc., to design chemical processes, or combinations thereof.

The present invention also relates to a method for controlling the pump arrangement of the present invention. The method comprises the steps of;

(i) filling the pumping chambers with fluids to be pumped until each pumping piston reaches a first position, (ii) selecting a first pump unit and initiating emptying of the corresponding pumping chamber by activating respective actuator. The activation of respective actuator can as one alternative be done by introducing a drive medium in a drive chamber in respective drive cylinder or by introducing a current in a coil in respective electromagnetic actuator. The selection of the first pump may be done randomly or according to a predetermined scheme, such as alternating between the pump units every other time.

The method further comprises repeating the steps of;

(iii) selecting another pump unit when the pumping piston of said activated pump unit has reached a second position, and initiating emptying of the pumping chamber of this other pump unit by activating the actuator, (iv) allowing both actuators to be active during a certain amount of time, thereby allowing any of the pumping pistons to move and deliver the fluids to be pumped, and (v) inactivating the actuator of the pump unit that reached said second position and initiating filling of the corresponding pumping chamber with fluids to be pumped until the pumping piston reaches said first position.

In the described way, one or more of the pumping pistons are always supplied with a forward-acting pumping force. By allowing two pump units to be active during a certain time period, without predetermining how the pumping pistons of the two pumping units are moving during said time period, a substantially pulseless pumping of the fluid is achieved.

The volume of the flow from at least one of said pump units of the pumped fluids is regulated based on the value dependent on the continuous position of the pumping piston in at least one of the pump units. In order to obtain a constant volume flow, the value dependent on the position of the pumping piston in at least one of the pump units is the sum of the velocities of the forward moving pumping pistons in the pumping cylinders. The flow of the pumped fluids may be regulated by adjusting the at least one valve on the delivery line or by adjusting the force applied to at least one pumping piston by the corresponding actuator.

Further alternative embodiments of the present invention are defined in the claims. In the following various embodiments of the invention will be explained in more detail with reference to the drawings. The drawings are for the purpose of illustrating the invention and are not intended to limit its scope.

DETAILED DESCRIPTION OF THE INVENTION

Figure 1:
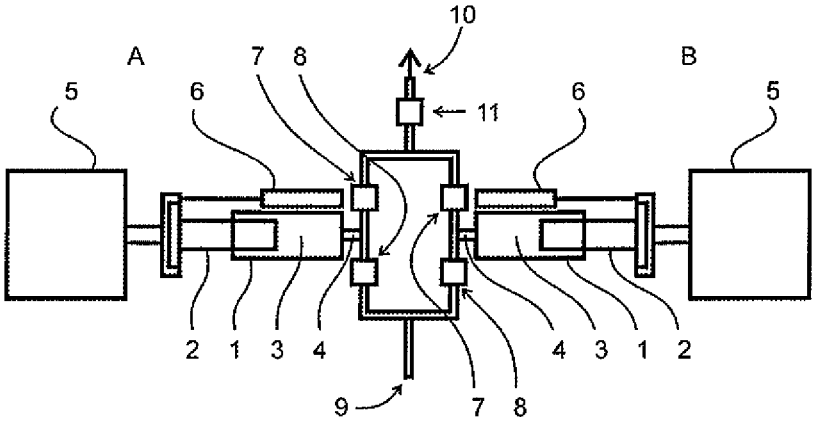
FIG. 1 shows a pump arrangement according to one embodiment of the invention.

In the figures, double lines are used to illustrate pipes, tubes or lines for fluids, and single lines are used to illustrate lines or wires for signals, such as control signals and signals related to measured parameters. A pump arrangement for pumping fluids comprising a first pump unit A and a second pump unit B is shown in FIG. 1. In the following, index A or B is redundant since the numbers include both where it is relevant. FIG. 1 shows that each of the pump units comprises a pumping cylinder 1 and a reciprocally movable pumping piston 2 in said pumping cylinder. The pumping piston delimits a pumping chamber 3 in the pumping cylinder, said pumping chamber being in communication with a pump port 4 for transportation of the fluids to be pumped in to and out from the pumping chamber. An actuator 5 is connected to the pumping piston, for moving said pumping piston in the pumping chamber. A linear displacement transducer 6 is connected to the pumping piston and arranged to determine the position of the pumping piston in the pumping cylinder.

A first set of valves, 7 and 8, connects the pump port 4 of each pump unit in the pump arrangement shown in FIG. 1 to a source 9 and a delivery line 10 for fluid to be pumped. The valves in the first set are arranged to permit a flow of fluids from the source line 9 to the delivery line 10. The valves are check valves, see further 7' and 8' in FIG. 2-4, but can as an alternative be on/off valves that are controlled to open and close during a pumping cycle of the arrangement in order to permit a flow of fluids from the source line 9 to the delivery line 10 via the pumping units.

The pump arrangement comprises means for regulating the flow of the fluids to be pumped based on the value dependent on the position of the pumping piston in at least one of the pump units. FIG. 1 shows a valve 11 on the delivery side of the pumping line in the pump arrangement. The valve 11 is controlled based on the position, velocity or acceleration of the pumping pistons in the pump units. In one embodiment, the valve 11 is a proportional valve. In another embodiment, the valve 11 is an on/off valve suitable for pulse-width modulation of the fluid flow.

In the following description of FIG. 2-4, when reference is made to features on one of the pump units in the pump arrangements, the same feature is applicable to both pump units in the pump arrangements, analogous to A or B in FIG. 1.

Figure 2:
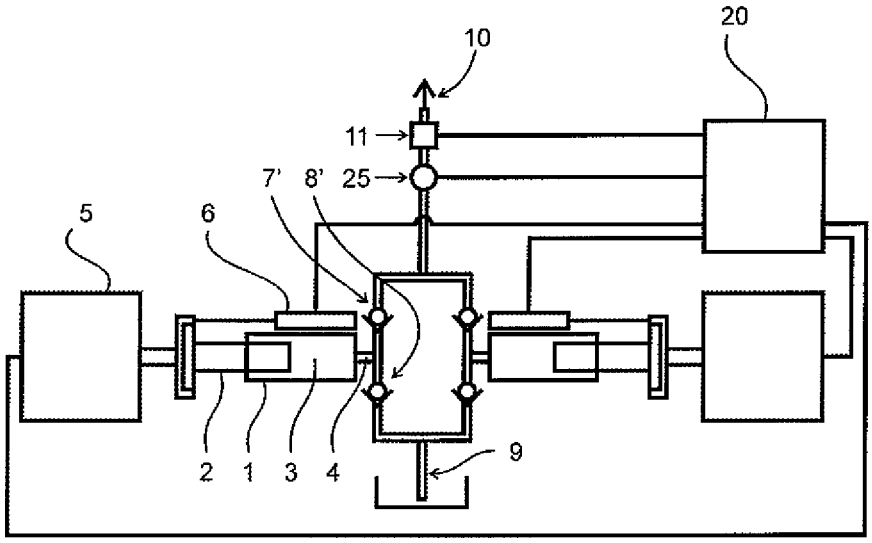
FIG. 2 shows a pump arrangement according to another embodiment of the invention.

The pump arrangement shown in FIG. 2 further comprises a computer based control unit system 20 arranged to receive values dependent on the position of the pumping pistons in the pumping cylinders in form of analog or digital position signals from the displacement transducers of the pump units, and arranged to send corresponding control signals to said means for regulating the flow of the fluids to be pumped. The pump arrangement further comprises a pressure sensor 25 on the delivery line, upstream of the means for regulating the flow of the fluids to be pumped. The computer based control unit system 20 in the pump arrangement shown in FIG. 2 is arranged to receive signals from the displacement transducers 6 and the pressure sensor 25, and send control signals to the actuators 5 and the valve 11 on the delivery line.

Figure 3:
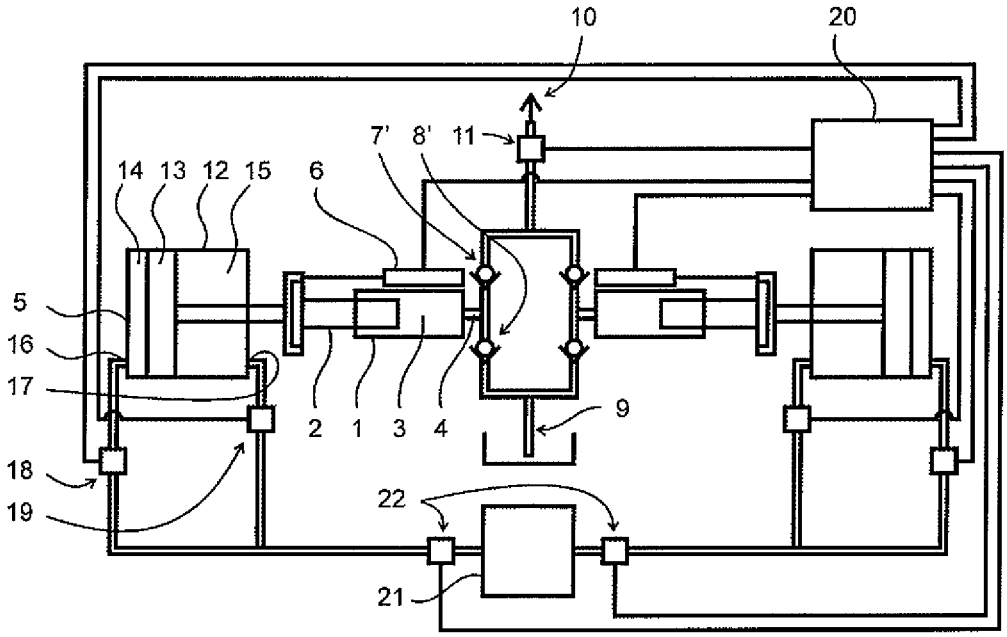
FIG. 3 shows a pump arrangement according to a further embodiment of the invention.

The pump arrangement shown in FIG. 3 comprises fluid power actuators for moving said pumping piston in the pumping chamber. Each fluid power actuator comprises a driving cylinder 12 with a reciprocally movable driving piston 13 in said driving cylinder, said driving piston dividing the driving cylinder into a first 14 and a second 15 driving chamber in communication with a first 16 and a second 17 drive port for drive medium. The fluid power actuators are provided with a second set of valves, 18 and 19, for controlling the delivery of drive medium to the first 14 and second 15 driving chambers of the pump units. The valves are on/off valves, but can as an alternative be arranged to continuously regulate the flow and/or pressure of the drive medium into or out from the corresponding drive chambers. The pump arrangement shown in FIG. 3 further comprises a pressure source 21 connected to the second set of valves of the pump units via regulating units 22 for regulating the pressure and/or flow of drive medium to the pump units. The regulating units 22 can be individually controlled and used to supply a different pressure of the drive medium to each pump unit in order to account for different conditions such as intrinsic variations in friction. The computer based control unit system 20 is in the pump arrangement shown in FIG. 3 is further arranged to send and/or receive signals to/from the valves 18 and 19, and the regulating units 22.

Figure 4:
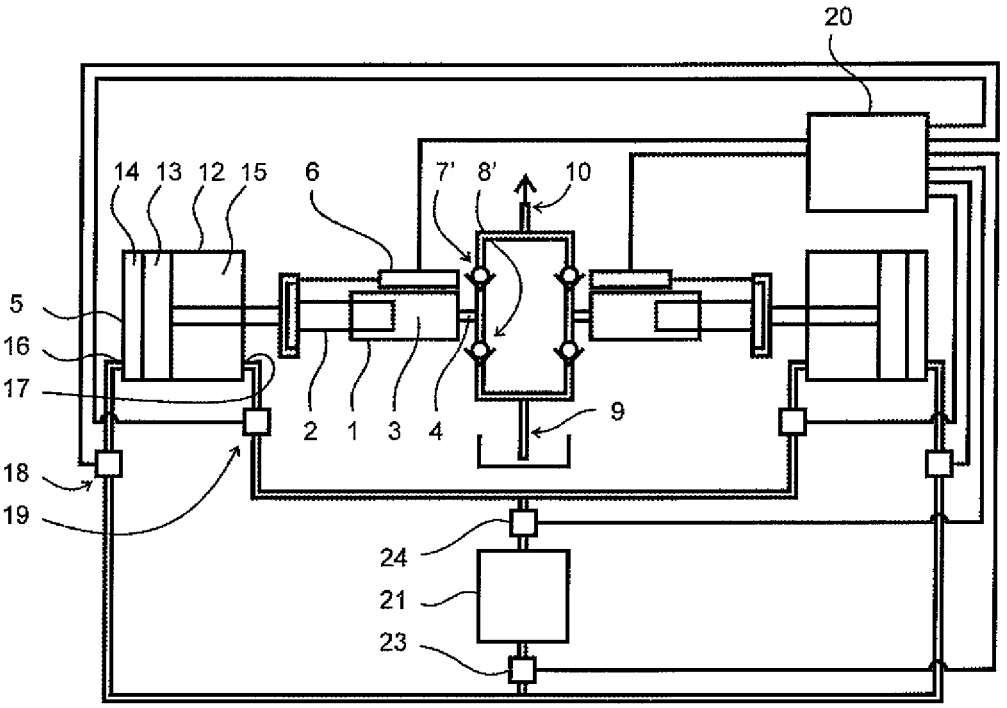
FIG. 4 shows a pump arrangement according to yet another embodiment of the invention.

The pump arrangement shown in FIG. 4 comprises fluid power actuators for moving said pumping piston in the pumping chamber. The pump arrangement further comprises a pressure source 21 connected to the second set of valves of the pump units via regulating units 23 and 24 for regulating the pressure and/or flow of drive medium to the different driving chambers of the pump units. The regulating unit 23 is arranged to deliver drive medium to the first driving chambers 14 and the regulating unit 24 is arranged to deliver drive medium to the second driving chambers 15 of the pump units. The regulating units 23 and 24 can be used to supply a different pressure of the drive medium to the first drive chambers and to the second drive chambers of the pump units in order to adjust the force applied on the pumping pistons during filling and emptying of the pumping chambers of the pump units with the fluid to be pumped. Thereby the filling of the pumping chambers can be fast and the risk of cavitation and leakage in the pumping chamber can be controlled.

The computer based control unit system 20 in the pump arrangement shown in FIG. 4 is arranged to send and/or receive signals to/from the displacement transducers 6, the valves 18 and 19 and the regulating units 23 and 24. In the pump arrangement shown in FIG. 4, the regulating units are controlled to regulate the pressure and/or flow of drive medium to the different driving chamber based on the position, velocity or acceleration of the pumping pistons in the pump units. As an alternative to the regulation of drive medium shown in FIGS. 3 and 4, drive medium can be delivered to the fluid power actuators directly from a pressure source or via a common regulating unit, such as a pressure regulator. As a further alternative, drive medium can be delivered to the valves 18 and 19 in connection with the fluid power actuators from separate, individually controllable pressure sources, or from a common pressure source via a set of regulating units, each connected to a single valve 18 or 19.

Figure 5:
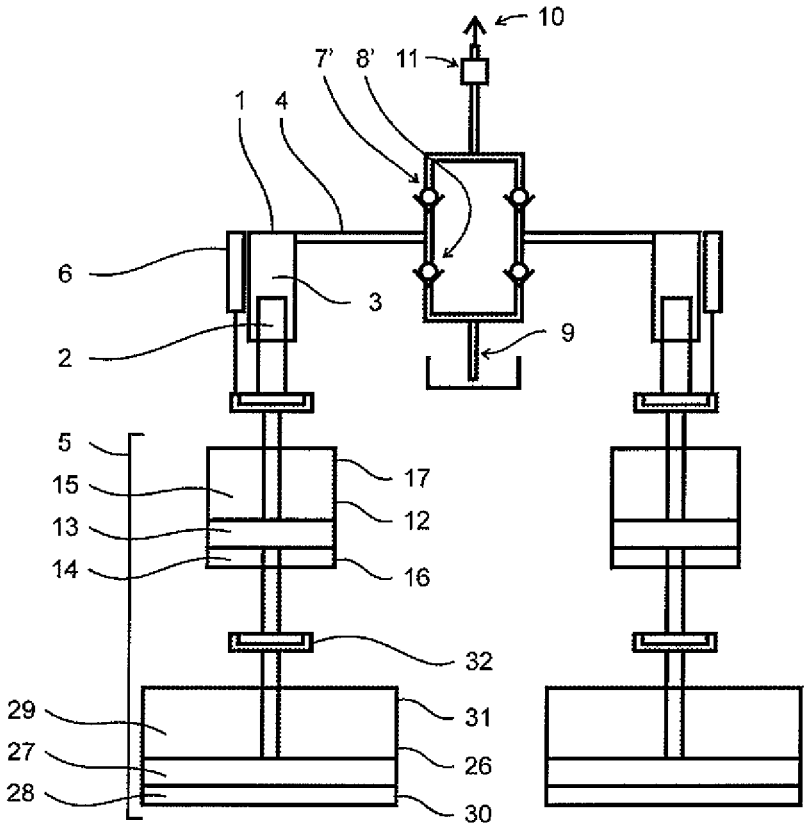
FIG. 5 shows a pump arrangement according to yet another embodiment of the invention.

FIG. 5 shows a pump arrangement where the actuators comprise an additional pair of driving cylinders 26 connected to the main driving cylinders 12. Each additional driving cylinder comprises a reciprocally movable driving piston 27 dividing the additional driving cylinder into a first 28 and a second 29 driving chamber in communication with a first 30 and a second 31 drive port for drive medium. The driving piston 27 in each additional driving cylinder is connected to the driving piston 13 in the main driving cylinder by a connector that is arranged to transfer a pushing force from the additional driving cylinder to the main driving cylinder. Any pulling force on the connector will break the connection. The driving piston 27 in the additional driving cylinder in the figure is provided with a rod comprising a cup in mechanical contact with a rod connected to the driving piston 13 of the main driving cylinder.

When the pumping piston of a pump unit in any of FIG. 1-5 is moved backward during filling of the pumping chamber, i.e. the pumping piston is moved in the direction of an increasing volume of the corresponding pumping chamber, fluid is drawn from the source line through the valve 8 or 8' into the pumping chamber. If the valves 7 and 8 are on/off valves, the valve 8 is open and the valve 7 is closed during the filling of the corresponding pumping chamber. The initial filling of the pumping chambers during the start-up phase of the pump arrangement is done by moving the pumping pistons of the pump units backward and forward in several strokes until the pumping chambers are filled and the pumping pistons are at a first position, said first position indicating a full, or almost full, pumping chamber. As an alternative, the pumping chambers are filled by only one filling stroke of the pumping pistons.

When the pumping piston of a pump unit is moved forward during emptying of the pumping chamber, i.e. the pumping piston is moved in the direction of a decreasing volume of the corresponding pumping chamber, fluid is pushed from the pumping chamber through the valve 7 or 7' into the delivery line. If the valves 7 and 8 are on/off valves, the valve 8 is closed and the valve 7 is open during the emptying of the corresponding pumping chamber.

For a pump unit comprising a fluid power actuator, as shown in FIGS. 3 and 4, the pumping piston is moved forward by supplying a drive medium to the first drive chamber 14 and venting the second drive chamber 15. The pumping piston is moved backward by supplying a drive medium to the second drive chamber 15 and venting the first drive chamber 14.

For a pump unit comprising an electromagnetic actuator the pumping piston is moved forward and backward by supplying currents of opposite directions through the coil of the actuator.

Figure 6:
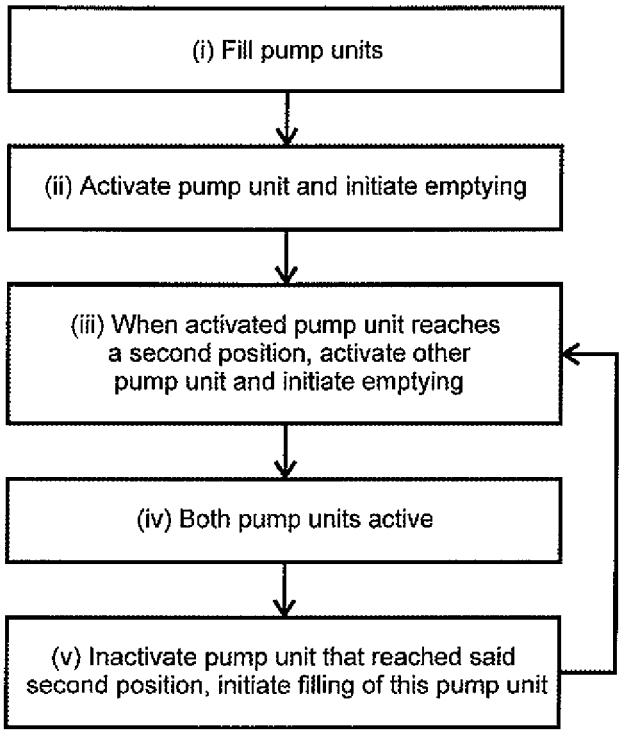
FIG. 6 shows a flow chart of a method for controlling a pump arrangement according to the invention.

FIG. 6 shows a flowchart of the process of controlling the pump arrangement according to one alternative of the invention. The process for controlling the pump arrangement comprises the following steps:

i) Filling the pumping chambers of the pump units with fluids to be pumped by moving the pumping pistons backward until each pumping piston has reached said first position, ii) Selecting a first pump unit and initiating emptying of the corresponding pumping chamber by activating the actuator of said first pump unit to apply a force to the pumping piston in the forward direction. As one alternative, the selection of the first pump is random. As another alternative, the selection of the first pump can be done according to a predetermined scheme, such as alternating every other time between the pump units.

The following steps iii-v are repeated during pumping:

iii) When the pumping piston of said activated pump unit has reached a second position, selecting the other pump unit (or another pump unit if the number of pump units is more than two) and initiating emptying of the corresponding pumping chamber by activating the actuator of said other pump unit to apply a force to the pumping piston in the forward direction. The second position can be set to indicate that the pumping chamber of the pump unit is about to become empty.

iv) During a certain time period, letting the actuators of both pump units to be active and applying force to the pumping pistons in the forward direction of each pumping piston, thereby allowing any of the pumping pistons to move and deliver the fluids to be pumped. It is not predetermined which pumping piston is moving at a certain point in time during said time period. Which pumping piston is moving is a result of individual conditions in the pump units, such as the friction of each pumping piston in respective pumping cylinder and variations in flow resistance within the pump arrangement.

v) After said time period, inactivating the pump unit that reached said second position and engaging the corresponding actuator in filling the pumping chamber with fluid to be pumped by moving said pumping piston backward until it has reached said first position.

What is claimed is:

1. A pump arrangement for pumping fluids, comprising at least a first and a second pump unit, each pump unit comprising:

a pumping cylinder, a reciprocally movable pumping piston in said pumping cylinder, said pumping piston delimiting a pumping chamber in the pumping cylinder, said pumping chamber being in communication with one or more pump ports for the fluids to be pumped, a pneumatic actuator connected to the pumping piston and operated by control valves for moving said pumping piston, and a transducer for determining a value dependent on the continuous position of the pumping piston in the pumping cylinder, said pump arrangement further comprises:

a set of inlet valves connecting each pump unit to a source line and a set of delivery valves connecting each pump unit to a delivery line, a regulating valve positioned in the delivery line downstream from the delivery valves, at least one regulating unit for regulating the force applied to respective pumping pistons via the control valves, and a control unit configured to send and receive signals for regulating the volume of the flow of the fluids to be pumped from each pump unit, the control unit controlling operation of the control valves of each pump unit as well as the at least one regulating unit, the control unit also being configured to control the regulating valve for regulating the flow from the pump units.

2. The pump arrangement according to claim 1, wherein the pneumatic actuator comprises:

a driving cylinder, a reciprocally movable driving piston in said driving cylinder, said driving piston dividing the driving cylinder into a first and a second driving chamber in communication with a first and a second drive port for a drive medium, said driving piston being connected to the pumping piston, wherein, the control valves control delivery of said drive medium to the driving chambers of a respective pump unit.

3. The pump arrangement according to claim 1, wherein said regulating valve comprises a proportional valve.

4. The pump arrangement according to claim 1, wherein said regulating valve comprises an on/off valve for pulse width modulation.

5. The pump arrangement according to claim 1, wherein said set of inlet valves comprise two check valves connecting each of the first and the second pump units to the source line and said set of delivery valves comprise two check valves connecting each of the first and the second pump units to the delivery line.

6. The pump arrangement according to claim 2, wherein the drive medium comprises pressurized gas.

7. The pump arrangement according to claim 2, wherein said control valves comprise valves for controlling the delivery of said drive medium with a pressure $P_1$ to the first driving chambers of the pump units.

8. The pump arrangement according to claim 7, wherein said control valves comprise valves for controlling the delivery of said drive medium with a pressure $P_2$ to the second driving chambers of the pump units.

9. The pump arrangement according to claim 8, wherein drive medium with pressure $P_1$ and $P_2$ is supplied to the pump units from a common pressure supply via at least one pressure regulator.

10. The pump arrangement according to claim 2, wherein the pumping piston has a cross-sectional area $A_P$ and the driving piston has a cross-sectional area $A_D$ and wherein the area $A_P$ is smaller than the area $A_D$.

11. The pump arrangement according to claim 2, wherein the pneumatic actuator comprises one or more additional driving cylinders, each additional driving cylinder comprising a reciprocally movable driving piston dividing said additional driving cylinder into a first and a second driving chamber in communication with a first and a second drive port for drive medium, said driving piston in said additional driving cylinder being connected to the driving piston in the driving cylinder or to the driving piston in the driving cylinder of another additional driving cylinder, said control valves further comprise valves for controlling the delivery of drive medium to the driving chambers of the additional driving cylinders.

12. The pump arrangement according to claim 2, wherein said control unit is configured to control the set of inlet valves and the set of delivery valves.

13. The pump arrangement according to claim 1, wherein the delivery line comprises a nozzle.

14. The pump arrangement according to claim 13, wherein the nozzle comprises a disperser element.

15. A pumping arrangement system comprising:

a continuous chemical reactor;

a pump arrangement for pumping fluids, comprising at least a first and a second pump unit, each pump unit comprising:

a pumping cylinder, a reciprocally movable pumping piston in said pumping cylinder, said pumping piston delimiting a pumping chamber in the pumping cylinder, said pumping chamber being in communication with one or more pump ports for the fluids to be pumped, a pneumatic actuator connected to the pumping piston and operated by control valves for moving said pumping piston, and a transducer for determining a value dependent on the continuous position of the pumping piston in the pumping cylinder, said pump arrangement further comprises:

a set of inlet valves connecting each pump unit to a source line and a set of delivery valves connecting each pump unit to a delivery line, a regulating valve positioned in the delivery line downstream from the delivery valves, at least one regulating unit for regulating the force applied to respective pumping pistons via the control valves, and a control unit configured to send and receive signals for regulating the volume of the flow of the fluids to be pumped from each pump unit, the control unit controlling operation of the control valves of each pump unit as well as the at least one regulating unit, the control unit also being configured to control the regulating valve for regulating the flow from the pump units;

wherein the delivery line is connected to a continuous chemical reactor port.

16. A method for controlling the pump arrangement as described in claim 1 or the system described in claim 15, said method comprising the steps of:

filling the pumping chambers with fluids to be pumped until each pumping piston has reached a first position, selecting a first pump unit and initiating emptying of the corresponding pumping chamber by activating its respective pneumatic actuator, further repeating the steps of:

when the pumping piston of said activated pump unit has reached a second position, selecting another pump unit and initiating emptying of respective pumping chamber by activating its respective pneumatic actuator, allowing both pneumatic actuators to be active during a certain amount of time without predetermining how the pumping pistons of the two pumping units are moving during said amount of time, thereby allowing any of the pumping pistons to move and deliver the fluids to be pumped, inactivating the actuation direction of the pump unit that reached said second position and initiating filling of its corresponding pumping chamber with fluids to be pumped until its pumping piston has reached said first position; and wherein the flow of the pumped fluids is regulated by the control unit by adjusting the regulating valve and adjusting the force applied to at least one pumping piston by the corresponding pneumatic actuator.

* * * * *